US010550676B2

(12) United States Patent
Pichilingue

(10) Patent No.: US 10,550,676 B2
(45) Date of Patent: Feb. 4, 2020

(54) SYSTEMS AND METHODS FOR DETERMINING PROPER PHASE ROTATION IN DOWNHOLE LINEAR MOTORS

(71) Applicant: Baker Hughes Incorporated, Houston, TX (US)

(72) Inventor: Renato L. Pichilingue, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 774 days.

(21) Appl. No.: 15/137,115

(22) Filed: Apr. 25, 2016

(65) Prior Publication Data

US 2016/0348487 A1 Dec. 1, 2016

Related U.S. Application Data

(60) Provisional application No. 62/169,063, filed on Jun. 1, 2015.

(51) Int. Cl.

| | |
|---|---|
| ***E21B 43/12*** | (2006.01) |
| ***F04B 17/03*** | (2006.01) |
| ***F04B 49/20*** | (2006.01) |

(52) U.S. Cl.

CPC ..... *E21B 43/128* (2013.01); *F04B 17/03* (2013.01); *F04B 49/20* (2013.01)

(58) Field of Classification Search

CPC .... E21B 43/128; E21B 47/0007; F04B 47/06; F04B 17/03; F04B 49/20

USPC ..... 417/45

See application file for complete search history.

(56) References Cited

U.S. PATENT DOCUMENTS

| | | | | |
|---|---|---|---|---|
| 5,060,737 | A | 10/1991 | Mohn | |
| 6,851,934 | B2 | 2/2005 | Yoo | |
| 8,698,447 | B2 * | 4/2014 | Lumsden | H02P 6/182 318/812 |
| 8,796,959 | B2 | 8/2014 | Sato | |
| 8,851,860 | B1 | 10/2014 | Mail | |
| 9,991,836 | B2 * | 6/2018 | Panchbhai | H02K 5/132 |
| 2005/0156473 | A1 | 7/2005 | Tosiya | |
| 2012/0263606 | A1 | 10/2012 | Bouldin | |

(Continued)

FOREIGN PATENT DOCUMENTS

| | | | |
|---|---|---|---|
| CN | 104215839 | A | 12/2014 |
| SU | 1226598 | A1 | 4/1986 |
| WO | WO2014082074 | | 5/2014 |

*Primary Examiner* — Essama Omgba
*Assistant Examiner* — Stephen A Mick
(74) *Attorney, Agent, or Firm* — Sprinkle IP Law Group

(57) ABSTRACT

Systems and methods for determining proper phase rotation in a linear motor where the phase rotations associated with power and return strokes are initially unknown. Power having an initial phase rotation is provided to a linear motor until the motor's mover reaches the end of the stroke, and then power to the motor is discontinued. While power is discontinued, the mover is monitored to detect its movement. if the mover moves without power, the mover was at the top of the stroke, so the initial phase rotation is associated with an upward stroke of the mover, and a second phase rotation which is opposite the initial phase rotation is associated with a downward stroke of the mover. Otherwise, the initial phase rotation is associated with the downward stroke of the mover and the second, opposite phase rotation is associated with the upward stroke of the mover.

9 Claims, 5 Drawing Sheets

(56) References Cited

U.S. PATENT DOCUMENTS

| | | | | |
|---|---|---|---|---|
| 2012/0292051 | A1* | 11/2012 | Wetzel | E21B 33/072<br>166/385 |
| 2013/0039778 | A1* | 2/2013 | Blackson | F04B 17/04<br>417/44.1 |
| 2014/0292112 | A1 | 10/2014 | Mukai | |
| 2015/0035458 | A1 | 2/2015 | Takase | |
| 2015/0098849 | A1* | 4/2015 | Bagagli | F04B 5/02<br>417/488 |

* cited by examiner

SYSTEMS AND METHODS FOR DETERMINING PROPER PHASE ROTATION IN DOWNHOLE LINEAR MOTORS

CROSS-REFERENCE TO RELATED APPLICATIONS

This application claims the benefit of U.S. Provisional Patent Application 62/169,063, filed Jun. 1, 2015 by Renato L. Pichilingue, which is incorporated by reference as if set forth herein in its entirety.

BACKGROUND

Field of the Invention

The invention relates generally to downhole tools for use in wells, and more particularly to means for determining the proper phase rotation for power that is supplied to a downhole linear motor.

Related Art

In the production of oil from wells, it is often necessary to use an artificial lift system to maintain the flow of oil. The artificial lift system commonly includes an electric submersible pump (ESP) that is positioned downhole in a producing region of the well. The ESP has a motor that receives electrical signals from equipment at the surface of the well. The received signals run the motor, which in turn drives a pump to lift the oil out of the well.

ESP motors commonly use rotary designs in which a rotor is coaxially positioned within a stator and rotates within the stator. The shaft of the rotor is coupled to a pump, and drives a shaft of the pump to turn impellers within the body of the pump. The impellers force the oil through the pump and out of the well. While rotary motors are typically used, it is also possible to use a linear motor. Instead of a rotor, the linear motor has a mover that moves in a linear, reciprocating motion. The mover drives a plunger-type pump to force oil out of the well.

In order to properly control a linear motor, it is desirable to know the electrical position of the mover within the stator. Linear motors may use several sensors (e.g., Hall-effect sensors) to determine the electrical position and absolute position of the mover. The signals from these sensors are provided to a control system, which then produces a drive signal based upon the position of the mover and provides this drive signal to the motor to run the motor.

An ESP using a linear motor typically operates on three-phase power. Each phase is carried by a separate conductor, and is typically shifted by 120 degrees from the other phases. An electrical drive system at the surface of the well generates the three-phase drive signal that is supplied to the motor, which in turn drives the pump. When the system is installed, it is commonly necessary to make various connections (e.g., cable splices) between the electrical conductors that convey the electrical power to the motor. It is not unusual for mistakes to be made in these connections, resulting in electrical connections between the electrical drive system and pump motor that are incorrect. More specifically, two or more of the conductors may be switched. Such misconnection of the conductors may also occur when maintenance is performed on the electrical drive system or the cabling.

Because the phasing of a three-phase electrical signal is reversed (e.g., A-B-C becomes C-B-A) when any two of the three wires are switched, misconnection of these wires can result in the pump motor being driven in a direction which is opposite the intended direction. In other words, when the electrical drive system produces a drive signal with phasing that is intended to drive the motor in the forward direction, it actually drives the motor in the reverse direction. In the case of a linear motor, the drive's output signal is intended to drive the upstroke/downstroke of the motor, so if the phase rotation is reversed, the mover will be driven upward when it is intended to be driven downward, and downward when it is intended to be driven upward. While this may still result in some fluid being produced from the well, it typically is not as efficient as if the proper phasing is used. Additionally, if the motor is intended to be driven in a particular manner on upward or downward strokes (e.g., faster on the downward stroke), this will actually occur on the opposite stroke.

It would therefore be desirable to provide improved means for determining the phasing at the output of the drive that is associated with a linear motor's upstroke and downstroke, and for utilizing this information to generate signals to drive the linear motor.

SUMMARY OF THE INVENTION

This disclosure is directed to systems and methods for determining the phasing of power generated by an electric drive system that is associated with the upward and downward strokes of a linear motor (for example, in an ESP). One particular embodiment is a method for determining proper phase rotation in a linear motor where the phase rotations associated with power and return strokes are initially unknown. In this method, power having an initial phase rotation is provided to a linear motor. Position sensor signals from position sensors in the linear motor are monitored, and it is determined from the position sensor signals when the mover of the linear motor has reached the end of the stroke that is driven by the initial phase rotation. After the mover has reached the end of the stroke, power to the linear motor is discontinued. When the power to the linear motor is discontinued or suspended, the position sensor signals from the position sensors in the linear motor are monitored to determine whether the mover moves. if the mover moves while the power to the linear motor is discontinued, the mover had moved to the top of the stroke, so the initial phase rotation is associated with an upward stroke of the mover, and a second phase rotation which is opposite the initial phase rotation is associated with a downward stroke of the mover. If, on the other hand, the mover does not move while the power to the linear motor is discontinued, the mover had moved to the top of the stroke, so the initial phase rotation is associated with the downward stroke of the mover and the second, opposite phase rotation is associated with the upward stroke of the mover.

This method may be implemented in an ESP system that is installed in a well. In one embodiment, a multiphase (e.g., 3-phase) power cable is initially coupled between an electric drive system and the ESP's linear motor so that the electric drive system provides the power the motor. The correspondence of phases at the electric drive system to phases at the linear motor at this point may be unknown. In other words, it is not known which of the phases (e.g., A, B, C) at the drive is connected to which of the phases (e.g., A', B', C') at the motor. When the power cable is first coupled between the drive and the motor, the motor is stopped. The power having the initial phase rotation is thereafter provided to the linear motor. In one embodiment, the downward stroke of the ESP system's motor is the power stroke and the upward stroke is the return stroke. After determining the correspondence between the initial and opposite phase rotations with the upward and downward strokes, and making the appropriate associations between them, the ESP system can be operated in a manner in which the power and return strokes are differentiated. For instance, power can be provided to the motor according to a power stroke profile during the power stroke and according to a return stroke profile during the return stroke. It can be determined in various ways when the initial phase rotation has driven the mover of the linear motor to the end of the stroke. For example, it may be determined that that the mover of the linear motor has reached a hard stop in the motor. Alternatively, signal transitions in the signals from the position sensors in the linear motor can be counted, and the end of the stroke may be identified by determining when a threshold number of signal transitions have been counted. Detecting signal transitions in the position sensor signals can also be used to determine whether the mover moves while the power to the linear motor is discontinued.

An alternative embodiment comprises an apparatus which is a controller for an electric drive system of a linear motor. In a startup phase, the controller is configured to generate output power for the linear motor, where the output power has an initial phase rotation that will drive the motor's mover either upward or downward. The controller monitors position sensor signals received from the linear motor and determines from these signals when the mover has reached the end of its stroke. The controller do this, for example, by detecting that a hard stop in the motor has been reached, or by counting signal transitions in the received sensor signals and determining that a threshold number of signal transitions have been counted. When the mover has reached the end of its stroke, the controller discontinues generation of the output power to the motor. With the power discontinued, the position sensor signals are monitored by the controller to determine whether the mover moves (falls). This may be done by determining whether any signal transitions are detected in the position sensor signals while the power is discontinued. If the mover moves while the power to the linear motor is discontinued, the mover is falling, so the controller associates the initial phase rotation with an upward stroke of the motor and associates the opposite phase rotation with the downward stroke of the motor. If, on the other hand, the mover does not move while the power to the linear motor is discontinued, The mover is already at the bottom of its travel, so the controller associates the initial phase rotation with the downward stroke of the motor and associates the opposite phase rotation with the upward stroke of the motor. After associating the initial and opposite phase rotations with respective ones of the upward and downward strokes, the controller may generate output power to run the linear motor, where the output power is generated according to a first stroke profile during the upward stroke of the linear motor and according to a second, different stroke profile during the downward stroke of the linear motor.

Another alternative embodiment comprises a system that includes an ESP system installed in a well. An electric drive system positioned at the surface of the well is coupled to the motor of the ESP system by one or more electrical cables that carry power from the electric drive system to the ESP system and carry position sensor signals from the sensors (e.g., Hall-effect sensors) in the ESP system's motor to the electric drive system. The electric drive system includes a controller that is configured to control the drive to generate output power for the linear motor. In a startup phase, the output power has an initial phase rotation. The controller monitors the position sensor signals received from the linear motor to determine when the motor's mover has reached the end of its stroke (travel), as driven by the initial phase rotation. The system then discontinues the output power and monitors the position sensor signals to determine whether the mover moves while the output power is discontinued. If the mover moves while the power to the linear motor is discontinued, the controller associates the initial phase rotation with the upward stroke of the motor and associates the opposite phase rotation with the downward stroke of the motor. If the mover does not move while the power to the linear motor is discontinued, the controller associates the initial phase rotation with the downward stroke of the motor and associates the opposite phase rotation with the upward stroke of the motor. After associating the initial and opposite phase rotations with respective ones of the upward and downward strokes, the drive may provide output power to run the ESP system's motor. The power provided to the motor may be generated according to a first stroke profile during the upward stroke of the linear motor and according to a second, different stroke profile during the downward stroke of the linear motor.

Numerous other embodiments are also possible.

BRIEF DESCRIPTION OF THE DRAWINGS

Other objects and advantages of the invention may become apparent upon reading the following detailed description and upon reference to the accompanying drawings.

Figure 1:
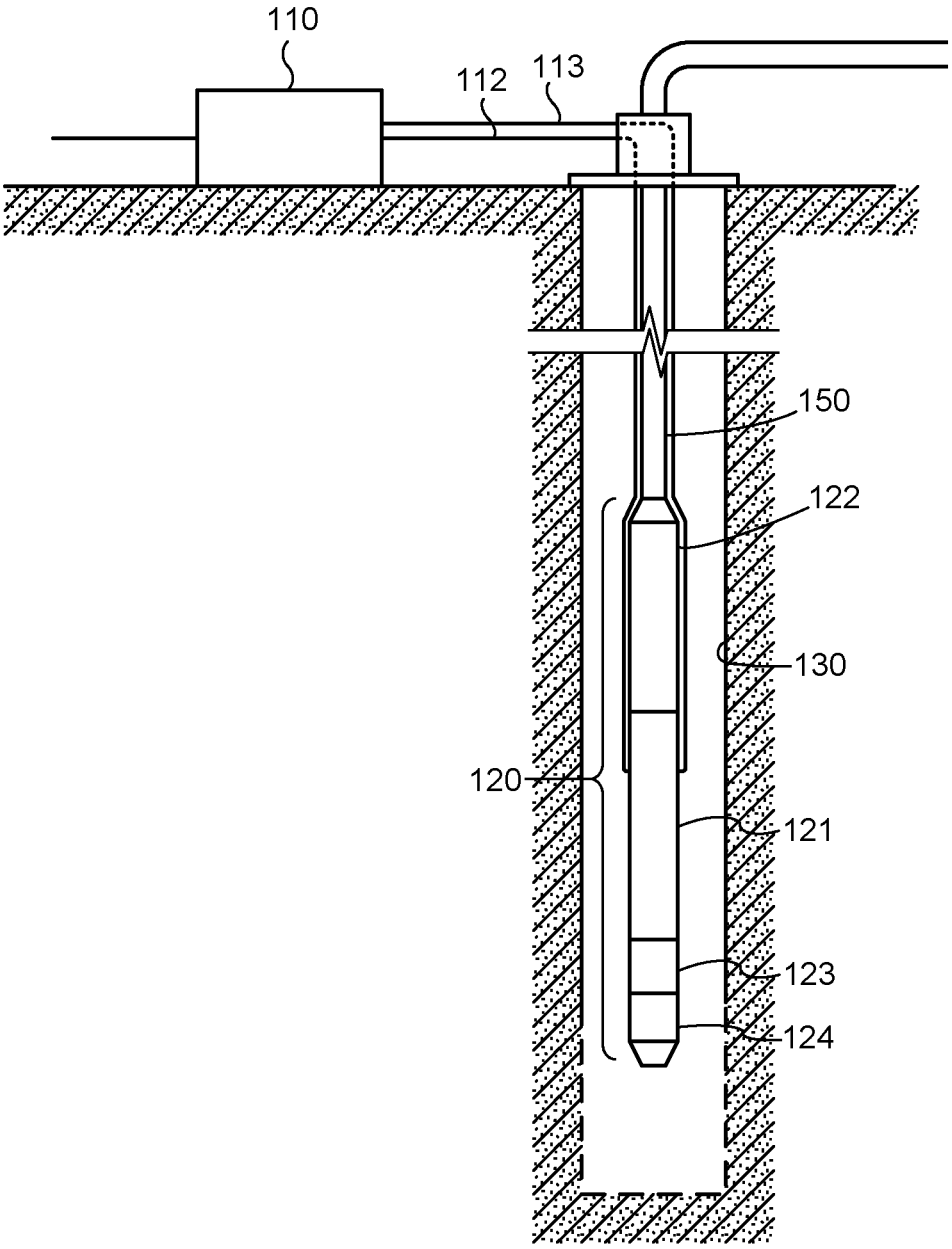
FIG. 1 is a diagram illustrating an exemplary pump system in accordance with one embodiment.

While the invention is subject to various modifications and alternative forms, specific embodiments thereof are shown by way of example in the drawings and the accompanying detailed description. It should be understood, however, that the drawings and detailed description are not intended to limit the invention to the particular embodiment which is described. This disclosure is instead intended to cover all modifications, equivalents and alternatives falling within the scope of the present invention as defined by the appended claims. Further, the drawings may not be to scale, and may exaggerate one or more components in order to facilitate an understanding of the various features described herein.

DETAILED DESCRIPTION OF EXEMPLARY EMBODIMENTS

One or more embodiments of the invention are described below. It should be noted that these and any other embodiments described below are exemplary and are intended to be illustrative of the invention rather than limiting.

As described herein, various embodiments of the invention comprise systems and methods for determining the phase voltage rotation (A-B-C or C-B-A) of an electric drive system that is required to drive a linear motor in a desired direction. ("Direction" as used here refers to the upward or downward motion of the mover.)

Generally speaking, in the present systems and methods, a controller of an electric drive system generates an output having a known phase rotation, and this output is provided to a linear motor. It does not matter whether the output phase rotation drives the upstroke or downstroke of the motor. The output voltage is provided to the motor until the motor's mover is driven to a hard stop at the end of its stroke, or until a predetermined number of hall transitions have occurred. After the mover is driven to the hard stop, the drive's output is discontinued. Gravity provides a downward force on the mover which, in the absence of a signal from the drive, will cause the mover to fall downward if it is at the top of the stroke. This movement will be detected by the position sensors in the motor. If movement is detected, then it is known that the initially applied phase rotation caused the mover to move upward. If no movement is detected (indicating that the mover is already at the bottom of the stroke), then it is known that the initially applied phase rotation caused the mover to move downward. In either case, the direction associated with the initially applied phase rotation is now known. The motor can therefore be operated normally with the proper phase rotation.

Referring to FIG. 1, a diagram illustrating an exemplary pump system in accordance with one embodiment of the present invention is shown. A wellbore 130 is drilled into an oil-bearing geological structure and is cased. The casing within wellbore 130 is perforated in a producing region of the well to allow oil to flow from the formation into the well. Pump system 120 is positioned in the producing region of the well. Pump system 120 is coupled to production tubing 150, through which the system pumps oil out of the well. A control system 110 is positioned at the surface of the well. Control system 110 is coupled to pump 120 by power cable 112 and a set of electrical data lines 113 that may carry various types of sensed data and control information between the downhole pump system and the surface control equipment. Power cable 112 and electrical lines 113 run down the wellbore along tubing string 150.

Pump 120 includes an electric motor section 121 and a pump section 122. In this embodiment, an expansion chamber 123 and a gauge package 124 are included in the system. (Pump system 120 may include various other components which will not be described in detail here because they are well known in the art and are not important to a discussion of the invention.) Motor section 121 receives power from control system 110 and drives pump section 122, which pumps the oil through the production tubing and out of the well.

In this embodiment, motor section 121 is a linear electric motor. Control system 110 receives AC (alternating current) input power from an external source such as a generator (not shown in the figure), rectifies the AC input power, converting it to DC (direct current) voltage of a specific value as determined by the controller which is then used to produce three-phase AC output power which is suitable to drive the linear motor. The output power generated by control system 110 is dependent in part upon the electrical position of the mover within the stator of the linear motor. Electrical position sensors in the motor sense the position of the mover and communicate this information via electrical lines 113 to control system 110 so that that electrical currents are properly and timely commutated (as will be discussed in more detail below). The output power generated by control system 110 is provided to pump system 120 via power cable 112.

Figure 2:
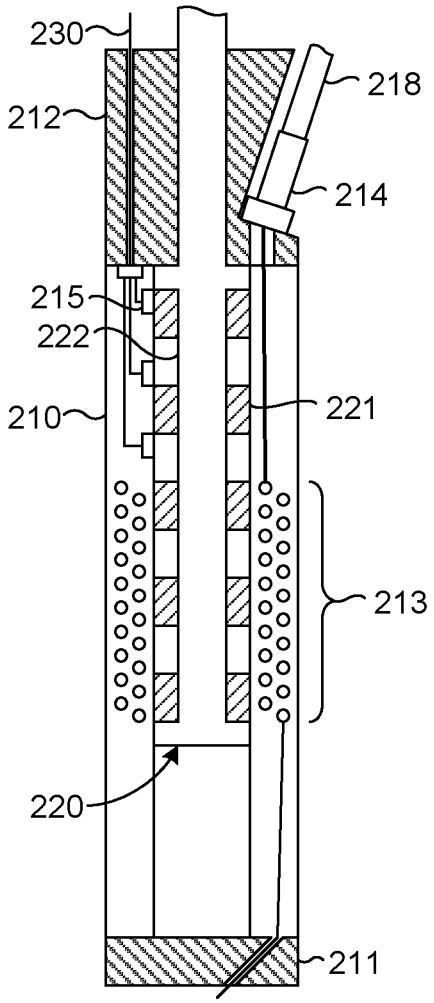
FIG. 2 is a diagram illustrating an exemplary linear motor in accordance with one embodiment which would be suitable for use in the pump system of FIG. 1.

Referring to FIG. 2, a diagram illustrating an exemplary linear motor which would be suitable for use in the pump system of FIG. 1 is shown. The linear motor has a cylindrical stator 210 which has a bore in its center. A base 211 is connected to the lower end of stator 210 to enclose the lower end of the bore, and a head 212 is connected to the upper end of the stator. Motor head 212 has an aperture therethrough to allow the shaft 222 of the mover 220 to extend to the pump. In this embodiment, the pump is configured to draw fluid into the pump on the upstroke and expel the fluid on the downstroke. In other words, the downstroke is the power stroke and the upstroke is the return stroke.

Stator 210 has a set of windings 213 of magnet wire. Windings 213 include multiple separate coils of wire, forming multiple poles within the stator. The ends of the windings are coupled (e.g., via a pothead connector 214) to the conductors of the power cable 218. Although the power cable has separate conductors that carry the three phase power to the motor, the conductors are not depicted separately in the figure for purposes of simplicity and clarity. Similarly, the coils of magnet wire are not separately depicted. The coils may have various different configurations, but are collectively represented as component 213 in the figure.

The windings are alternately energized by the current received through the power cable to generate magnetic fields within the stator. These magnetic fields interact with permanent magnets 221 on the shaft 222 of mover 220, causing mover 220 to move up and down within the motor. The waveform of the signal provided by the drive via the power cable (in this case a three-phase signal) is controlled to drive mover 220 in a reciprocating motion within the bore of stator 210. Stator 210 incorporates a set of Hall-effect sensors 215 to monitor the electrical position of mover 220 within stator 210. The outputs of Hall-effect sensors 215 are transmitted to the controller and can be used to determine absolute position. They may be transmitted as distinct signals, or they may be combined to form one or more composite signals. The mover may also be coupled to an absolute encoder of some type, and data from this encoder may be transmitted to the controller. The controller then tracks the motor position based on the received signals.

Figure 3A:
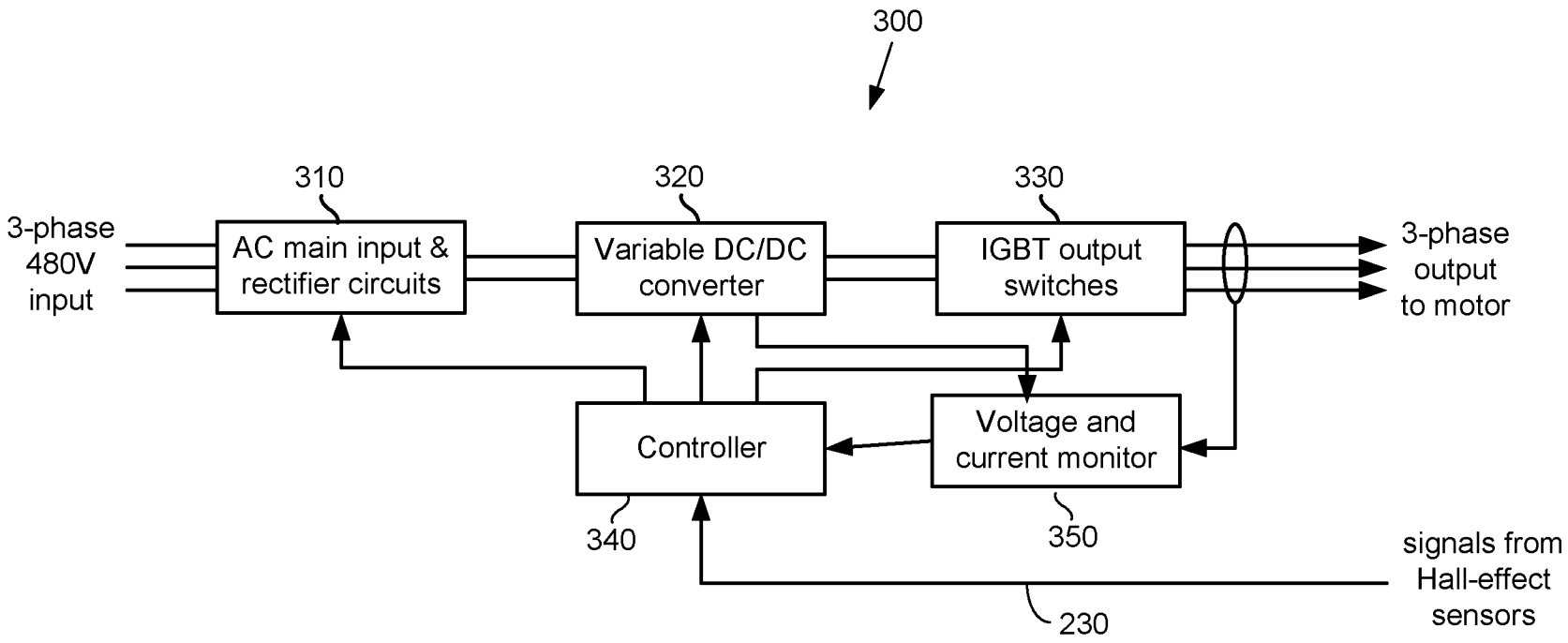
FIGS. 3A and 3B are functional block diagrams illustrating the structure of control systems for a linear motors in accordance with two exemplary embodiments.

Referring to FIG. 3A, a functional block diagram illustrating the structure of a control system for a linear motor in one embodiment is shown. The control system is incorporated into a drive system (e.g., 110) for the linear motor. The drive system receives AC input power from an external source and generates three-phase output power that is provided to the linear motor to move the pump. The drive system also receives position information from the linear motor and uses this information when generating the three-phase power for the motor.

As depicted in FIG. 3A, drive system 300 has input and rectifier circuitry 310 that receives AC input power from the external power source. The input power may be, for example, 480V, three-phase power. Circuitry 310 converts the received AC power to DC power at a voltage determined by the line value and provides this power to a first DC bus. The DC power on the first DC bus is provided to a variable DC-DC converter 320 that outputs DC power at a desired voltage to a second DC bus. The voltage of the DC power output by DC-DC converter 320 can be adjusted within a range from 0V to the voltage on the first DC bus, as determined by a voltage adjustment signal received from motor controller 340. The DC power on the second DC bus is input to an inverter 330 which produces three-phase output power at a desired voltage and frequency as determined by the controller. The output power produced by inverter 330 is transmitted to the downhole linear motor via a power cable.

The power output by inverter 330 is monitored by voltage monitor 350. Voltage monitor 350 provides a signal indicating the voltage output by inverter 330 as an input to motor controller 340. Motor controller 340 also receives position information from the downhole linear motor. In one embodiment, this position information consists of the signals generated by the Hall-effect sensors as described above in connection with FIG. 2. Motor controller 340 uses the received position information to determine the position and speed of the mover within the linear motor. Based upon this position and speed information, as well as the information received from voltage monitor 350, controller 340 controls inverter 330 to generate the appropriate output signal.

In one embodiment, motor controller 340 may control the switching of insulated gate bipolar transistors (IGBT's) in inverter 330 to generate a three-phase, 6-step, trapezoidal or sinusoidal waveform. The three phases of the drive's output may be identified as phases A, B and C. As noted above, although the drive system outputs are known, it is not uncommon for misconnection of the conductors between the drive system and the downhole motor to occur. Consequently, although the outputs of the drive system are intended to be provided to respective inputs of the downhole motor (e.g., output A to input A', output B to input B', and output C to input C'), it is not known whether this is actually the case. The drive system is therefore configured to identify the phasing at its output that will provide the proper input phasing at the motor.

It is assumed for the purposes of this disclosure that the phase differences between the three phases of the drive unit's output signals are substantially equal. When any two of the phases are switched, the effect is to reverse the order of the phases. For instance, if the phases on lines A, B and C occur in the order A-B-C, switching the signals on any two of the lines will result in the phase order C-B-A. It is therefore assumed that any output signal generated by the drive unit will have one of these two orders (which may be referred to herein as phasings or phase rotations).

In this embodiment, the controller is configured to generate an output that has a predetermined phase rotation. This will cause the mover to go to the end of one stroke (either the upward or downward stroke). The drive then discontinues the output. If the mover is left at the lower end of the motor, it will simply remain stationary. If the mover is left at the upper end of the motor, it will begin to fall, and the movement will be detected by the controller. Then, based on whether the initial output signal moved the mover upward or downward, the controller can determine the proper phasing to drive the motor. This is described in more detail in connection with FIG. 4.

Figure 3B:
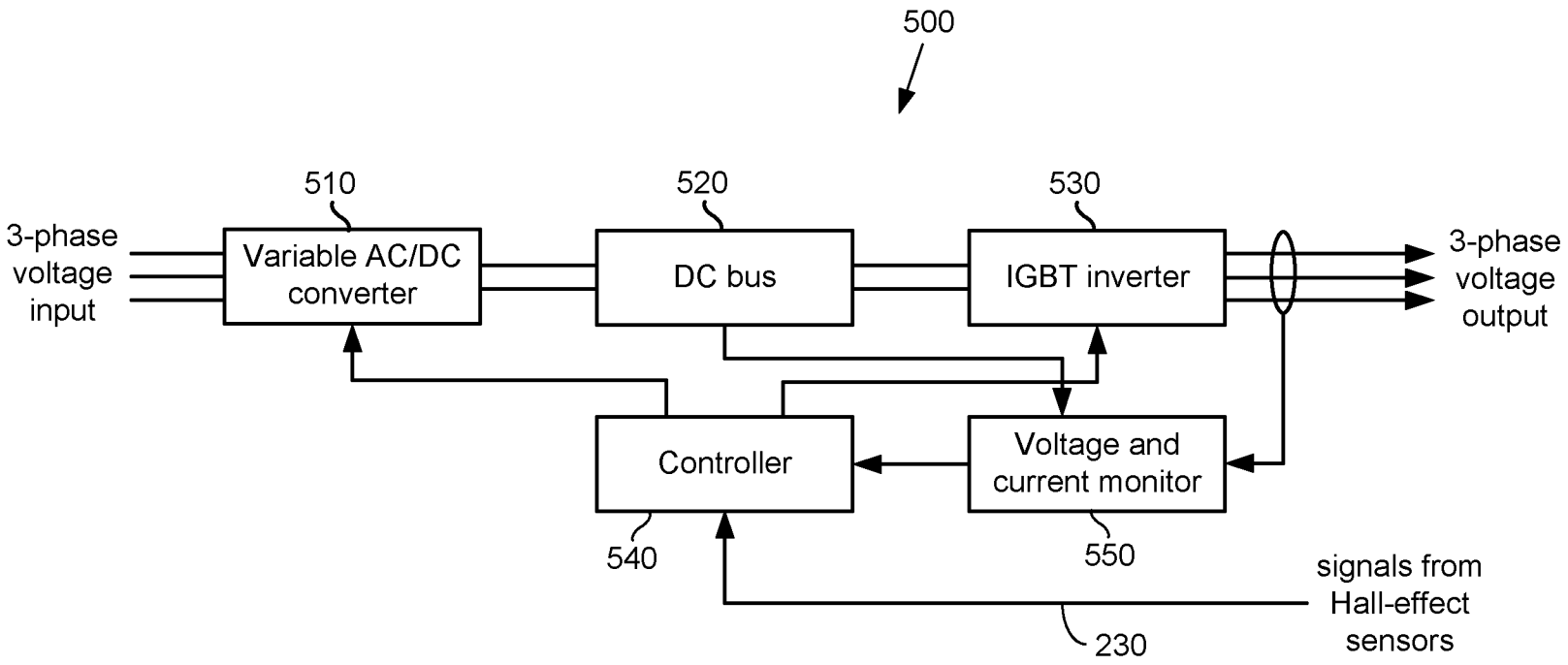

Referring to FIG. 3B, a functional block diagram illustrating an alternative structure of a control system for a linear motor is shown. The control system is incorporated into a drive system (e.g., 110) for the linear motor. The drive system again receives AC input power from an external source and generates three-phase output power for the linear motor. The drive system uses feedback on its voltage and current output, as well as position information from the motor, to control generation of the three-phase power for the motor.

As depicted in FIG. 3B, drive system 500 has a variable AC/DC converter that converts the received AC power to DC. The DC power is provided to DC bus 520. The DC power on bus 520 is used by IGBT inverter 530 to produce three-phase output power at a desired voltage and frequency as determined by controller 540. The output power produced by IGBT inverter 530 is transmitted to the downhole linear motor via a power cable.

The power output by IGBT inverter 530 is monitored by voltage and current monitor 550. Monitor 550 provides voltage and current information to motor controller 540. Motor controller 540 also receives position information from the position sensors in the downhole linear motor. Controller 540 uses the received position information to determine the position and speed of the mover within the linear motor. Based upon the information received by controller 540, IGBT inverter 530 is controlled to generate the appropriate output signal. The methods described above (e.g., in connection with FIG. 4) are implemented in controller 540 in a manner similar to controller 340 of FIG. 3.

Figure 4:
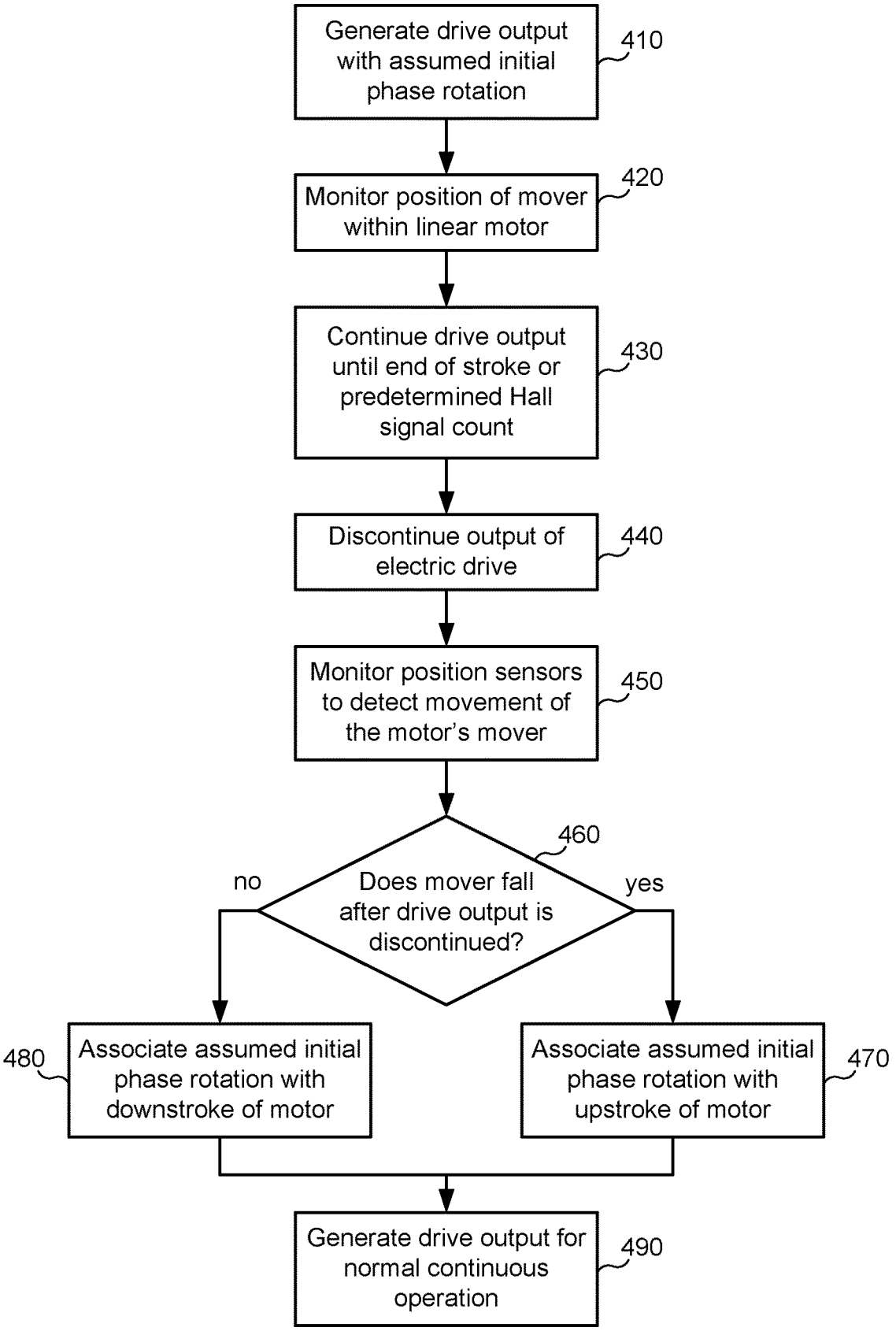
FIG. 4 is a flow diagram illustrating a method for determining whether a phase rotation is associated with an upstroke or downstroke of a linear motor in accordance with one embodiment.

Referring to FIG. 4, a flow diagram illustrating a method in accordance with one embodiment is shown. In this embodiment, an electric drive which is coupled to a downhole electric linear motor generates an output voltage in a startup phase that has an assumed phase rotation (410). More specifically, the phase rotation is known at the output of the drive, but is assumed at the input to the motor, since the power conductors may have been misconnected. The drive may generate an output that has, for example, the sequence A, B, C. In other words, the voltage at output A is 120 degrees ahead of the voltage at output B, which is 120 degrees ahead of the voltage at output C.

The output of the drive is carried to the linear motor via a power cable and is applied to the inputs of the motor. The position of the mover within the motor is monitored by means such as signals from position sensors within the motor (420). As noted above, some of the conductors of the power cable may have been switched, so it is unknown which of the drive outputs is applied to which of the motor inputs. The predetermined phase rotation of the signals received from the drive cause the motor's mover to move in one direction (which is not yet known). The signals are applied until the mover reaches the end of the stroke (430). In one embodiment, the signals are applied until the mover reaches a hard stop at the end of the stator. Alternatively, the drive output may be applied to the motor until a predetermined number of Hall signal transitions are detected. After the mover reaches the hard stop, or after the predetermined number of Hall signal transitions are detected, the drive output is discontinued (440).

With the drive output discontinued, the only remaining force on the mover is that of gravity. The position of the mover within the motor is monitored to determine whether gravity causes it to move (450). If the position sensors in the motor detect movement of the mover (460) (e.g., if transitions are detected in the signals from the Hall-effect sensors), it is assumed that the initial phase rotation caused the mover to move upward (the return stroke in this embodiment). After the mover stopped at the top of the stroke, it began falling due to gravity. The initial phase rotation is therefore determined to be the proper phase rotation for the upward (return) stroke and is associated with this upstroke (470). Thus, if the initial phase rotation produced by the drive was A-B-C, this rotation will be associated with the upward (return) stroke, and the C-B-A phase rotation will be associated with the downward (power) stroke.

If, on the other hand, the position sensors in the motor do not detect movement of the mover after the drive output is discontinued, it is assumed that the initial phase rotation caused the mover to move downward (the power stroke in this embodiment). Because the mover would stop at the hard stop at the bottom of the stroke in this case, gravity would not cause it to move after the drive output was discontinued. The initial phase rotation is therefore determined to be the proper phase rotation for the downward (power) stroke and is associated with the downstroke (480). If the initial predetermined phase rotation was A-B-C, this phase rotation will be associated with the downward (power) stroke, and the C-B-A phase rotation will be associated with the upward (return) stroke.

It should be noted that, although this embodiment uses Hall-effect sensors to detect movement of the mover, alternative embodiments may use other means. For instance, one alternative embodiment may monitor the conductors of the power cable to identify a back-emf (electromotive force) that is generated by movement of the mover. In this embodiment, the motor effectively acts as a generator and, as the mover falls, the motor generates a voltage at its input terminals.

When it has been determined which direction is associated with the initial predetermined phase rotation, the drive can begin generating output signals to operate the linear motor normally (490) (i.e., generating signals that drive the mover alternately through the power and return strokes). Because the phasing associated with the power and return strokes are known, the electric drive's controller can implement desired output profiles in which there are differences between the power and return strokes. For example, the mover may be driven at different speeds during the power and return strokes, different delays may be implemented at the ends of the respective strokes, and so on.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the described embodiments. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the described embodiment.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention as detailed within the present disclosure.

What is claimed is:

1. An apparatus comprising:

a controller of an electric drive system for a linear electric motor, wherein in a startup phase, the controller is configured to generate output power for the linear electric motor, wherein the output power has an initial phase rotation, monitor position sensor signals received from the linear electric motor, determine from the position sensor signals when a mover of the linear electric motor has reached the end of a stroke driven by the generated output power having the initial phase rotation, in response to determining that the mover of the linear electric motor has reached the end of the stroke, discontinue generating the output power, and monitor the position sensor signals and determine from the position sensor signals whether the mover moves while the output power is discontinued;

wherein in response to determining that the mover moves while the power to the linear electric motor is discontinued, the controller is configured to associate the initial phase rotation with an upward stroke and associate a second phase rotation which is opposite the initial phase rotation with a downward stroke; and wherein in response to determining that the mover does not move while the power to the linear electric motor is discontinued, the controller is configured to associate the initial phase rotation with the downward stroke and associating the second phase rotation which is opposite the initial phase rotation with the upward stroke.

2. The apparatus of claim 1, wherein the controller is further configured to, after associating the initial and opposite phase rotations with respective ones of the upward and downward strokes, generate output power for the linear electric motor, wherein the output power is generated according to a first stroke profile during the upward stroke of the linear electric motor and according to a second stroke profile during the downward stroke of the linear electric motor.

3. The apparatus of claim 1, wherein the controller is configured to determine when the mover of the linear electric motor has reached the end of the stroke by counting signal transitions in the received sensor signals and determining that a threshold number of signal transitions have been counted.

4. The apparatus of claim 1, wherein determining from the position sensor signals whether the mover moves while the power to the linear electric motor is discontinued comprises determining whether any signal transitions are detected in the position sensor signals.

5. A system comprising:

an electric submersible pump (ESP) system installed in a well;

an electric drive system positioned at the surface of the well; and one or more electrical cables coupled between the electric drive system and the ESP system, wherein the one or more electrical cables carry power from the electric drive system to the ESP system and carry position sensor signals from the ESP system to the electric drive system;

wherein the electric drive system includes a controller for a linear electric motor of the ESP system;

wherein in a startup phase, the controller is configured to generate output power for the linear electric motor, wherein the output power has an initial phase rotation, monitor the position sensor signals received from the linear electric motor, determine from the position sensor signals when a mover of the linear electric motor has reached the end of a stroke driven by the generated output power having the initial phase rotation, in response to determining that the mover of the linear motor has reached the end of the stroke, discontinue generating the output power, and monitor the position sensor signals and determine from the position sensor signals whether the mover moves while the output power is discontinued;

wherein in response to determining that the mover moves while the power to the linear electric motor is discontinued, the controller is configured to associate the initial phase rotation with an upward stroke and associate a second phase rotation which is opposite the initial phase rotation with a downward stroke; and wherein in response to determining that the mover does not move while the power to the linear electric motor is discontinued, the controller is configured to associate the initial phase rotation with the downward stroke and associating the second phase rotation which is opposite the initial phase rotation with the upward stroke.

6. The system of claim 5, wherein the electric drive system is configured to, after the initial and opposite phase rotations are associated with respective ones of the upward and downward strokes, provide power to the linear electric motor, wherein the power is generated by the electric drive system according to a first stroke profile during the upward stroke of the linear electric motor and according to a second stroke profile during the downward stroke of the linear electric motor.

7. The system of claim 5, wherein the controller is configured to determine when the mover of the linear electric motor has reached the end of the stroke by counting signal transitions in the received sensor signals and determining that a threshold number of signal transitions have been counted.

8. The system of claim 5, wherein determining from the position sensor signals whether the mover moves while the power to the linear electric motor is discontinued comprises determining whether any signal transitions are detected in the position sensor signals.

9. The system of claim 5, wherein the linear electric motor includes a plurality of Hall-effect position sensors and circuitry that combines a plurality of outputs generated by the Hall-effect position sensors into a composite signal that is communicated to the controller, wherein the position sensor signals comprise the composite signal.

* * * * *